US005199573A

United States Patent [19]

Gribovsky

[11] Patent Number: 5,199,573

[45] Date of Patent: Apr. 6, 1993

[54] GOLF ACCESSORY ORGANIZER

[76] Inventor: Vladimir Gribovsky, 6301 Bayridge Rd., Mound, Minn. 55364

[21] Appl. No.: 691,456

[22] Filed: Apr. 25, 1991

[51] Int. Cl.[5] ..... B65D 71/00

[52] U.S. Cl. ..... 206/579; 206/37; 206/38; 206/315.1

[58] Field of Search ..... 206/38, 37, 315.1, 579, 206/232, 234

[56] References Cited

U.S. PATENT DOCUMENTS

| | | | |
|---|---|---|---|
| 1,683,996 | 9/1928 | Snow | 206/37 |
| 2,667,199 | 1/1954 | Knee | 206/38 |
| 2,779,461 | 1/1957 | Schweitzer | 206/37 R |
| 3,058,506 | 10/1962 | Parisi | 206/37 |
| 3,753,519 | 8/1973 | Gammon | 206/579 |
| 3,799,331 | 3/1974 | White | 206/579 |
| 4,741,372 | 5/1988 | Santilli | 206/37 |
| 4,945,961 | 8/1990 | Healy | 206/39 |

FOREIGN PATENT DOCUMENTS

| | | | |
|---|---|---|---|
| 0472005 | 2/1929 | Fed. Rep. of Germany | 206/38 |
| 196814 | 4/1922 | United Kingdom | 206/37 |

*Primary Examiner*—David T. Fidei

*Assistant Examiner*—Thomas P. Hilliard

*Attorney, Agent, or Firm*—Peterson, Wicks, Nemer & Kamrath

[57] ABSTRACT

An organizer (10) for golf accessories is disclosed including a cover (12) and a liner (20) connected by their peripheries and folded about a fold line (32) into overlying first and second halves (34,36). A tube is formed by spine support stitching (38) extending parallel to and spaced from the fold line (32) and frictionally, slideably receives the first leg (44) of a clip holder (42). The second leg (46) of the clip holder (42) sandwiches a golf card (48) against the spine support stitching (38). A ball mark repair tool holder (16) is formed by a pouch stitched to the outside of the second half (36) of the cover (12). A holder (22) for a notebook or pad (24) is formed by a slit in the liner (20) for slideable insertion of the back (26) of the notebook or pad (24) between the cover (12) and the liner (20). A holder (40) for a pen or pencil is formed by a U-shaped strip having its free ends secured between the liner (20) by the spine support stitching (38). Indicia areas (14,18) are also provided for providing information and identification for the organizer (10).

11 Claims, 1 Drawing Sheet

GOLF ACCESSORY ORGANIZER

BACKGROUND

The present invention generally relates to organizers for golf accessories and particularly to golf accessory organizers which can be carried in the golfer's pocket.

While playing or watching the play of golf, various accessories are desirable to aid in keeping track of play and the score of play as well as aid in the actual play of golf. Such accessories include golf cards, pens or pencils, notebooks, hole yardage and information pads, ball mark repair tools, tees, and the like. Golf cards are often attached to holders secured to golf carts, which, if watching rather than playing golf, are not utilized. Likewise, pads and notebooks possibly including protective covers or holders are often placed in the pocket of the users. However the present invention, such accessories were generally haphazardly positioned at various locations according to the whim of the user and generally in nonrepeatable, disorganized fashion.

Thus a need exists for a device for holding various golf accessories in an organized manner.

It is thus an object of the present invention to provide an organizer for golf accessories.

It is further an object of the present invention to provide such a golf accessory organizer which can be carried in the golfer's pocket.

It is further an object of the present invention to provide such a golf accessory organizer which holds the golf accessories as a single unit without loose components which can fall from the organizer during use.

It is further an object of the present invention to provide such a golf accessory organizer which is very ornamental and aesthetic in appearance.

It is further an object of the present invention to provide such a golf accessory organizer which can be easily and economically manufactured.

Surprisingly, the above objectives and others like them can be accomplished by a golf accessory organizer according to the teachings of the present invention. Specifically, first and second halves of a cover interconnected together along a fold line are further secured together generally parallel to and spaced from the fold line with the first half overlying the second half in book fashion. The tube formed thereby receives a portion of a card holder which holds a golf card in page fashion between the first and second halves.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
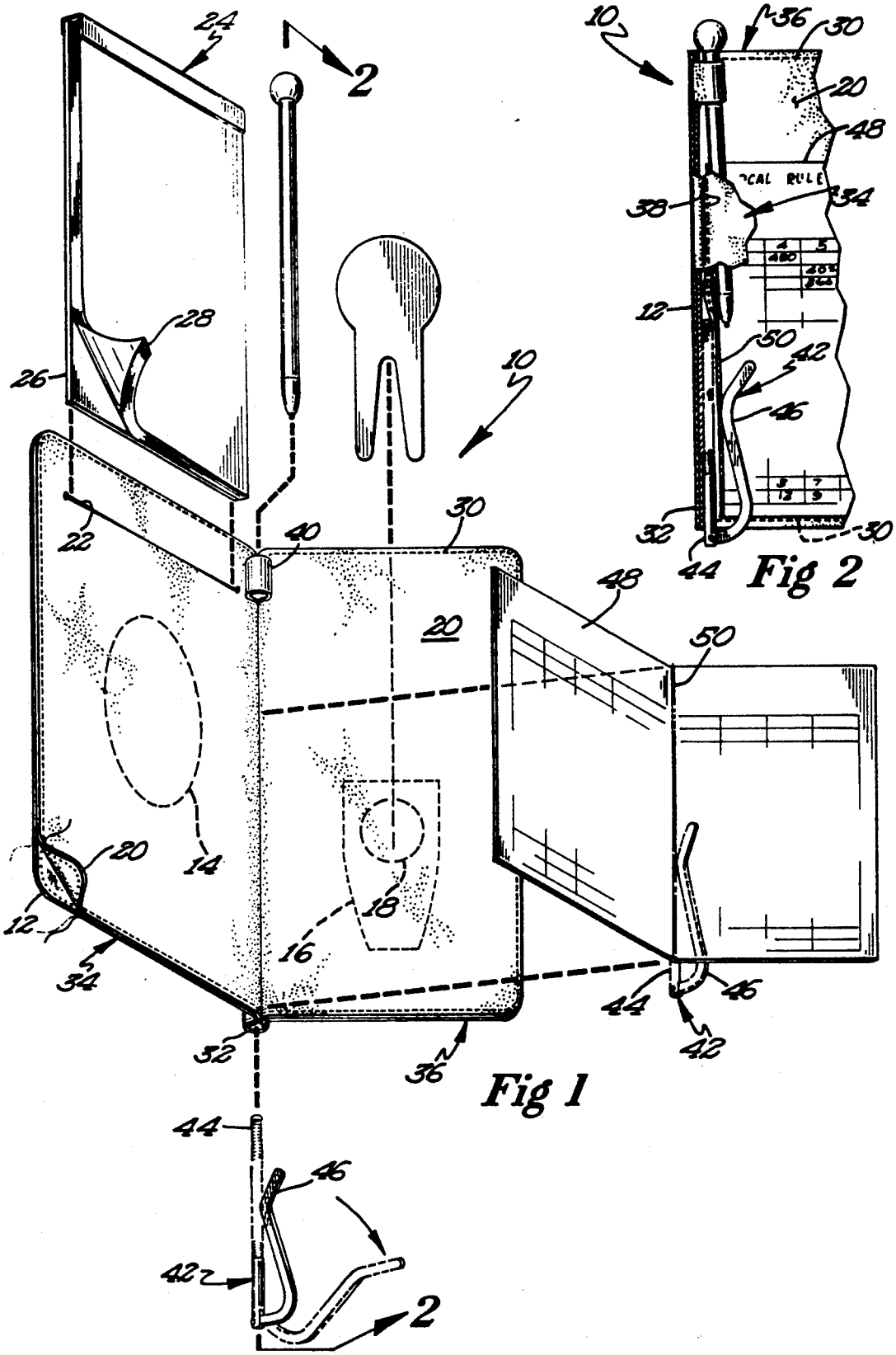
FIG. 1 shows an exploded perspective view of a golf accessory organizer in its open position according to the preferred teachings of the present invention.
FIG. 2 shows a partial, side view of the golf accessory organizer of FIG. 1 in its closed position, with portions broken away to expose constructional details.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inside", "outside", "upper", "lower", "right", "left", and similar terms are used herein, it should be understood that these terms have reference only to the structure shown in the drawings as it would appear to a person viewing the drawings and are utilized only to facilitate describing the invention.

DESCRIPTION

A golf accessory organizer according to the preferred teachings of the present invention is shown in the drawings and generally designated 10. Organizer 10 generally includes a generally rectangular-shaped cover 12, preferably formed of leather but can be formed of vinyl, plastic, naugahyde, or like material. Generally, cover 12 should be formed of flexible material which is pleasant to the touch of the intended user.

Cover 12 generally includes an indicia area 14 located on the outside of right half 34 of cover 12. A logo, insignia, emblem, or the like can be embossed, debossed (plain or gold/silver film overlay), embroidered, stamped, or put on by any process available for the type of material used is forming cover 12 in area 14.

Cover 12 further includes a holder 16 located on the outside of left half 36 of cover 12 and for holding a ball mark repair tool. In the preferred form, holder 16 is in the form of a pouch double stitched to cover 12. In the most preferred form, holder 16 is formed of the same material which forms cover 12.

Holder 16 can include an indicia area 18. Identification information such as trademarks of the manufacturer, information required by the government or regulatory agency of the particular location where organizer 10 will be sold, and other information can be embossed, debossed (plain or gold/silver film overlay), embroidered, stamped, or put on by any process available for the type of material used in forming holder 16 in area 18.

Organizer 10 further generally includes a liner 20 of a size and shape complementary and generally equal to cover 12. Liner 20 is preferably formed of imitation suede leather but can be formed of leather, vinyl, plastic, naugahyde, or like material. Generally, liner 20 should be formed of flexible material which is pleasant to the touch of the intended user. The periphery of liner 20 is secured to the periphery of cover 12 by any suitable means 30 such as by stitching as done by a sewing machine or can be ornamental as done by lacing leather.

Liner 20 further includes a holder 22 located on the inside of right half 34 of liner 20 and for holding a notebook and/or hole yardage and information pad 24. In the preferred form, holder 22 is in the form of a slit to receive the back 26 of pad or notebook 24 such that back 26 of pad 24 would extend through the slit and be positioned between cover 12 and liner 20 and with the pages 28 of pad 24 positioned parallel to liner 20 opposite cover 12 and between halves 34 and 36.

Cover 12 and liner 20 are interconnected together and folded about a fold line 32 in book fashion to position first half 34 to overlie second half 36 of a complementary shape and size, with liner 20 sandwiched between cover 12. Suitable means 38 are provided for biasing half 34 in the position overlying second half 36 while allowing halves 34 and 36 to be pivoted generally about fold line 32. In the preferred form, means 38 secure halves 34 and 36 together shown in the most preferred form as spine support stitching extending through halves 34 and 36 and generally parallel to but spaced from fold line 32.

Organizer 10 further includes a holder 40 located between halves 34 and 36 for holding a pen or pencil therebetween. In the most preferred form, holder 40 is in the form of a tube for slideably receiving a portion of the pen or pencil, with the tube made by spine support stitching 38 capturing the free ends of a U-shaped member between halves 34 and 36, with tube 40 extending generally parallel to and spaced from fold line 32 and spine support stitching 38. Tube 40 can be formed of the same material forming cover 12 or liner 20, or can be formed of other like material.

Organizer 10 further includes a holder 42 for holding a card in page fashion intermediate liner 20 of halves 34 and 36. In the most preferred form, holder 42 is in the form of a clip having a first, generally straight portion or leg 44 and a second, generally S-shaped portion or leg 46, with the outside ends of legs 44 and 46 being pivotally interconnected for movement between a first, abutting position generally parallel to each other and a second, open position extending at an angle from each other. In the most preferred form, legs 44 and 46 can be locked in their second position but are biased towards their first position when forced out of their second position. In the most preferred form, spine support stitching 38 is spaced from fold line 32 sufficiently such that cover 12 and liner 20 form a tube for slideably receiving leg 44 with leg 46 positioned between halves 34 and 36 on the side of spine support stitching 38 opposite leg 44. The tube formed by spine support stitching 38 should be of a size to frictionally hold or retain leg 44. In the preferred form, with half 34 pivoted or opened in relation to half 36, leg 46 can be pivoted to and locked in the second position. A golf card 48 or the like can be placed intermediate leg 46 and liner 20. At that time, leg 46 can be forced from the second position and will pivot under bias to the first position. In the first position, golf card 48 is sandwiched and captured between spine support stitching 38 and leg 46. Golf card 48 especially those having horizontal lists of holes can be folded along a fold line 50 extending generally parallel to fold line 32 and spine support stitching 38 such that golf card 48 can be folded to extend around and sandwich leg 46 in a page fashion inside of halves 34 and 36. Liner 20 can be slit along spine support stitching 38 to allow positioning of clip 42 inside of cover 12.

In the preferred form, clip 42 is positioned adjacent the lower edge and opposite holder 40. Further, the tube formed by spine support stitching 38 opposite clip 42 can slideably, frictionally receive a pen or pencil, the clip of a pen or pencil, a golf tee, or a like item.

It can then be appreciated that organizer 10 according to the teachings of the present invention is particularly advantageous in holding various golfing accessories including but not limited to a golf card, ball mark repair tool, pen or pencil, notebook and/or hole yardage and information pad, and the like as a single unit and in a very organized manner. Further, when such golf accessories are not being utilized, organizer 10 can be conveniently placed in the golfer's pocket for easy and handy access when necessary while leaving the golfer's hands free for other needs.

Now that the basic teachings of the present invention have been explained, many extensions and variations will be obvious to one having ordinary skill in the art. For example, although ball mark repair tool holder 16 is shown in the preferred form located on second half 36 of cover 12 opposite first half 34, holder 16 can be positioned as desired at other locations including intermediate first and second halves 34 and 36. An advantage of placing holder 16 on the outside of organizer 10 is that the dirt on the tool will not be exposed to the inside of organizer 10 or any accessory such as pad 24, pen or pencil, or card 48 located in the interior of organizer 10.

Similarly, although holder 16 is shown as a pouch in the most preferred form of the present invention, holder 16 can take other forms. For example, a first pair of parallel elongated slits can be formed above second and third pairs of parallel elongated slits, with the second and third pairs of slits being in line but spaced from each other and parallel to the first pair. The tool can be extended into and through the pairs of slits, with the strip between the first pair of slits holding the middle of the head of the tool and with the strips between the second and third pairs of slits holding the first and second legs of the tool, with the head of the tool abutting with the upper slits of the second and third pairs stopping downward movement of the tool. It can also be appreciated that the pairs of slits can be formed in cover 12 or liner 20. Also, rather than forming strips by parallel slits, such strips could be formed separately from and attached to cover 12 or liner 20.

Likewise, although holder 40 is shown as a tube in the most preferred form of the present invention, holder 40 can take other forms. For example, spaced strips formed by slits in the material or by securing separate pieces of material can form openings for slideably receiving the pen or pencil, with the pen or pencil being captured between the strips and the material. It can be appreciated that such strips can be placed in a variety of locations on cover 12 or liner 20. Further, as previously indicated, the tube formed by spine support stitching can also be utilized for holding a pen or pencil. Any variance of size of the tube for receiving clip 42 and the pen or pencil can be compensated by spine support stitching 38 being formed as single, double, or triple rows of stitches.

Furthermore, although holder 22 is shown as a slit in the most preferred form of the present invention, holder 22 can take other forms. For example, a strip of material can be secured to either cover 12 or liner 20 at any variety of positions for slideably receiving the pad or notebook 24 or back 26 thereof. It should also be noted that such a strip can also form or incorporate holder 40.

Further, although holder 42 is shown as a clip in the most preferred form of the present invention, holder 42 can take other forms. For example, a heavy duty circular plastic cord can extend through the tube defined by spine support stitching 38 and between halves 34 and 36 adjacent to spine support stitching 38. Such cord can be plain or wound, colored, or natural. The cord can then be stretched away from spine support stitching 38 to allow insertion of card 48 and then released to capture card 48 page fashion intermediate halves 34 and 36.

It can be appreciated that the corners of the peripheries of cover 12 and liner 20 can be either square or rounded, can be left plain and/or can be finished with custom made brass corners. Such features will create various unique aesthetic ornamental appearances for organizer 10 according to the teachings of the present invention.

Likewise, the number, type, and location of indicia areas 14 and 18 can be varied according to the teachings of the present invention.

Although organizer 10 has been shown and described according to the preferred teachings of the present invention including multiple features which are believed to be synergistically related, it can also be appreciated that organizer 10 can omit such features or incorporate other features including but not limited to the features set forth previously according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein

What is claimed is:

1. Organizer for golf accessories including a golf card comprising, in combination: a cover having a first half and a second half of a shape and size complementary to the first half, with the first and second halves being interconnected together along a fold line; means for securing the first half and the second half together along a spine support line extending generally parallel to and spaced from the fold line, with the securing means biasing the first half to overlie the second half in book fashion; a tube formed by the cover by and between the fold line and the securing means; means for holding the golf card in page fashion between the first and second halves comprising a first portion extending in the tube and a second portion interconnected to the first portion, with the golf card being sandwiched between the second portion and the securing means; and means for holding a pen or pencil between the first and second halves, wherein the pen or pencil holding means comprises a U-shaped member having free ends, with the free ends of the U-shaped member captured by the securing means between the first and second halves to define a tube for slideably receiving a portion of the pen or pencil.

2. Organizer for golf accessories including a golf card comprising, in combination: a cover having a first half and a second half of a shape and size complementary to the first half, with the first and second halves being interconnected together along a fold line; means for securing the first half and the second half together along a spine support line extending generally parallel to and spaced from the fold line, with the securing means biasing the first half to overlie the second half in book fashion; a tube of a constant size and formed by the cover by and between the fold line and the securing means; means for holding the golf card in page fashion between the first and second halves comprising a first portion extending and frictionally held in the tube and a second portion interconnected to the first portion, with the golf card being sandwiched between the second portion and the securing means; wherein the card holding means comprises a clip, with the first and second portions being legs; wherein the second leg is pivotably interconnected to the first leg; and means for holding a pen or pencil between the first and second halves comprising a U-shaped member having free ends, with the free ends of the U-shaped member captured by the securing means between the first and second halves to define a tube for slideably receiving a portion of the pen or pencil.

3. The golf accessory organizer of claim 2 further comprising, in combination: means for holding a ball mark repair tool on the cover.

4. The golf accessory organizer of claim 3 wherein the ball mark repair tool holding means is located on the second half on the side opposite the first half.

5. The golf accessory organizer of claim 4 wherein the ball mark repair tool holding means comprises a pouch secured to the second half for slideably receiving the ball mark repair tool.

6. The golf accessory organizer of claim 5 further comprising, in combination: means for holding a notebook or pad between the first and second halves.

7. The golf accessory organizer of claim 6 further comprising, in combination: a liner of a size and shape complementary to the cover; and means for securing the periphery of the liner to the periphery of the cover, with the liner located between the first and second halves of the cover when the first half overlies the second half.

8. The golf accessory organizer of claim 7 wherein the notebook or pad holding means comprises a slit formed in the liner for slideably receiving the back of the notebook or pad, with the back of the notebook or pad positioned between the cover and the liner and with the pages of the notebook or pad positioned parallel to the liner opposite the cover.

9. The golf accessory organizer of claim 2 further comprising, in combination: a liner of a size and shape complementary to the cover; and means for securing the periphery of the liner to the periphery of the cover, with the liner located between the first and second halves of the cover when the first half overlies the second half.

10. The golf accessory organizer of claim 9 further comprising, in combination: means for holding a notebook or pad between the first and second halves.

11. The golf accessory organizer of claim 2 wherein the securing means comprises stitching extending through both the first half and the second half generally parallel to and spaced from the fold line.

* * * * *